US006599148B1

(12) United States Patent
Jensen et al.

(10) Patent No.: US 6,599,148 B1
(45) Date of Patent: Jul. 29, 2003

(54) STRAIN RELIEVED LEADING-IN CONNECTION FOR SIGNAL CABLES WITH TWISTED WIRE PAIRS

(75) Inventors: Morten Petri Jensen, Hobro (DK); Ulrik Nielsen, Silkeborg (DK)

(73) Assignee: Cekan/CDT A/S, Gjern (DK)

( * ) Notice: Subject to any disclaimer, the term of this patent is extended or adjusted under 35 U.S.C. 154(b) by 0 days.

(21) Appl. No.: 09/673,252

(22) PCT Filed: Apr. 23, 1999

(86) PCT No.: PCT/DK99/00230

§ 371 (c)(1),
(2), (4) Date: Dec. 8, 2000

(87) PCT Pub. No.: WO99/56369

PCT Pub. Date: Nov. 4, 1999

(30) Foreign Application Priority Data

Apr. 24, 1998 (DK) ..... 00568/98

(51) Int. Cl.[7] ..... H01R 13/58
(52) U.S. Cl. ..... 439/460; 439/464; 439/941
(58) Field of Search ..... 439/464, 460, 439/941

(56) References Cited

U.S. PATENT DOCUMENTS 2,100,009 A * 11/1937 Hardy ..... 439/314
4,002,392 A * 1/1977 Hardesty ..... 439/418
4,636,024 A * 1/1987 Yahata ..... 439/449
5,568,584 A 10/1996 Smith
5,571,035 A * 11/1996 Ferrill ..... 439/941
5,899,770 A * 5/1999 Ezawa ..... 439/941
6,083,052 A * 7/2000 Adams ..... 439/676
6,123,572 A * 9/2000 Ishii ..... 439/465

FOREIGN PATENT DOCUMENTS

| | | |
|---|---|---|
| GB | 2197089 | 5/1988 |
| WO | WO 9326071 | 12/1993 |
| WO | WO 9747063 | 12/1997 |

* cited by examiner

*Primary Examiner*—Tho D. Ta
*Assistant Examiner*—Larisa Tsukerman
(74) *Attorney, Agent, or Firm*—Nixon Peabody LLP; David S. Safran

(57) ABSTRACT

In the termination of signal cables with two or more wire pairs, it is customary to effect a clamping of the cable in order to relieve the strain on the wires themselves and the terminal connections. This, however, results in an uncontrollable re-arrangement of the wire pairs with associated interference between them. With the invention, this is avoided in that the termination or the strain-relieving element is configured with mutually separated lead-in passages for the individual wire pairs, and with associated clamping means for each of the wire pairs led through the passage. There is hereby achieved a well-controlled electrical separation between the wire pairs, and also an improved mechanical strain relief, i.e. by a primary clamping of the wire pairs themselves. By using a wedge part for insertion into the end of the cable, it can be ensured that the wire pairs extend from the end of the cable in an evenly inclining manner, whereby signal reflections from the area will be minimised.

5 Claims, 3 Drawing Sheets

STRAIN RELIEVED LEADING-IN CONNECTION FOR SIGNAL CABLES WITH TWISTED WIRE PAIRS

BACKGROUND OF THE INVENTION

1. Field of the Invention

The invention relates to a strain-relieved leading-in connection for signal cables with twisted wire pairs. In particular, the present invention concerns a strain-relieved leading-in connection for signal cables with a cable jacket and with several twisted wire pairs, respectively an apparatus or a connection element of the plug or socket type with such a leading-in connection, where clamping means are provided for co-operation with the cable for the strain-relieving of a closely disposed termination area for the wires in the cable. Regardless of whether the ends of the wires are terminated by soldering or clamping, it will be unfortunate if forces arising on the cable shall be absorbed solely by these assemblies. The same applies for current supply cables, also including those for power lines where, e.g. in connection with input plugs, it is quite traditional to use strain-relieving by firm clamping of the cable in the relevant lead-in connection.

2. Description of Related Art

It must be ascertained that precisely this form of relieving technique has by and large been practiced in the signal cable area, i.e., by a simple clamping of the cable between opposing clamping strips, which with good tightening provides an excellent strain relief, in that the clamped-together cable jacket, which normally consists of flexible plastic, will pack well around the leads and hereby secure these with great friction. However, it is precisely with signal cables that this gives rise to distinct problems, which will now be explained in more detail with reference to FIGS. 1 and 2 of the drawing:

FIG. 1 is a schematic view of a cross-section of a signal cable with an outer cable jacket 2 and a number of internal wire pairs, designated 4*a–d*.

Typically, each pair of cables is twisted with a quite definite pitch which is different from the others, and the pairs are twisted around one another throughout the whole length of the cable. In principle, this provides a perfect electrical balance between the wires in the individual pairs and between the pairs.

FIG. 2 shows that, when the same cable is terminated in a plug, by today's standard, the round cable will be pressed into a common lead-in passage where, typically by using common clamping means 6, the jacket 2 with the wire pairs 4 are squeezed in a random and often quite unfortunate manner, in that the twist conditions are changed to a dramatic extent. Note, e.g., pairs 4*a* and 4*c*, where the possibility is created for a very inductive coupling, the reason being that the pair twisting has been ruined. The signal carried by the cable is hereby brought into great unbalance, in that undesirable signal coupling is generated between these pairs. Moreover, the impedance seen in the strain relief will be changed considerably because of the ruined pair twisting. This results in undesirable signal reflection from the cable relieving point.

In FIG. 3 is shown another known way of providing strain-relief for signal cables. Use is made here of a lead-through opening with an annular clamping arrangement 6 which can secure the cable by clamping around the cable jacket. This will result in less disturbance of the twist conditions, but on the other hand, will give rise to an unfortunate tight squeezing together of the twisted wire pairs. The cable Jacket can be secured in a reasonably effective manner by a moderate twisting together, but as indicated in FIG. 3, traction and/or torsion in the cable with thus give rise to longitudinal movements of the wire pairs, so that the termination points are loaded by these movements. Consequently, the terminations become unstable, regardless of whether use is made of soldering, crimping, blade contacts or the like.

SUMMARY OF THE INVENTION

The object of the invention is to provide a lead-in connection which does not display the above-mentioned disadvantages, and according to the invention this can be achieved by dividing the lead-in area into mutually separated lead-in passages for the individual wire pairs, in that each of these passages is provided with clamping means for the clamping of the wire pairs which are led through them. It will be seen that a fixing of the cable jacket is hereby more or less done away with, but on the other hand, it is achieved that the wire pairs will be completely separated and be individually and effectively secured, so that the termination areas are spared for undesirable influences on the cable. The individual wire pairs naturally cannot absorb the same high forces as those which can be absorbed by a strong clamping of the whole of the cable, but by virtue of the surface pressure against the insulation layer of the wires in the respective wire pairs, a particularly good holding effect can, however, still be created, and which in by far the majority of cases will be fully adequate.

In practice it will be necessary—and even directly desirable—for the wire pairs to be led to lead-in positions -in which they are mutually separated by an even greater distance than inside the cable. The electrical couplings arising between the pairs will hereby be automatically weakened, and -it will thus be of less importance that the regular twisting of the individual wire pairs can be disturbed quite locally in the individual lead-in passages.

The invention will now be explained in more detail with reference to the drawing.

DETAILED DESCRIPTION OF THE INVENTION

Figure 1:
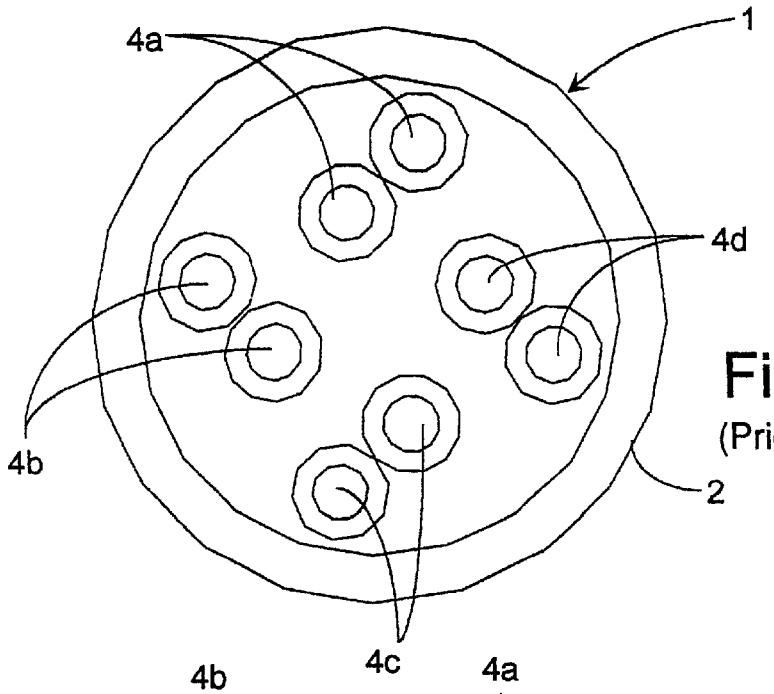
Fig.1 (Prior Art)
FIGS. 1–3 are illustrations respectively of a signal cable and two known methods of strain-relieved lead-in connections as already described.
Figure 2:
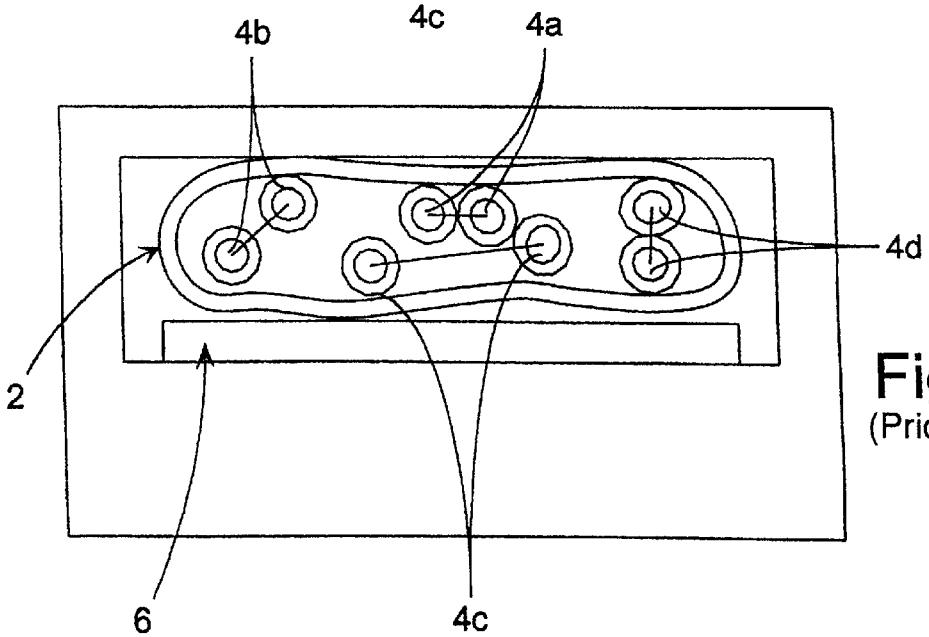
Fig.2 (Prior Art)
Figure 3:
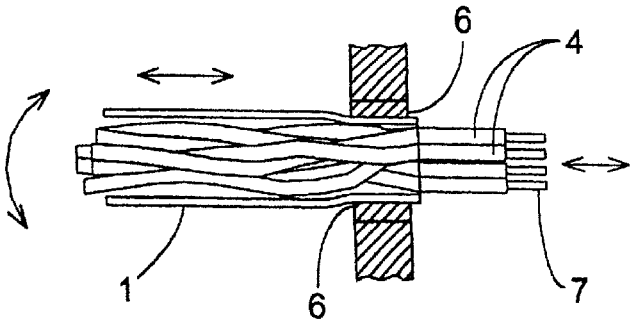
Fig.3 (Prior Art)
Figure 4:
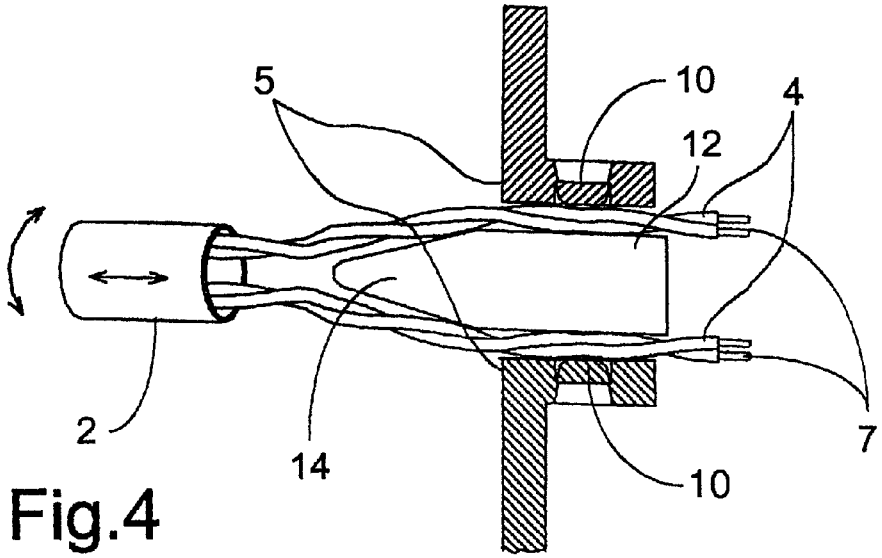
FIGS. 4 and 5 are related longitudinal and cross-sectional views for the illustration of a lead-in connection according to the invention.
Figure 5:
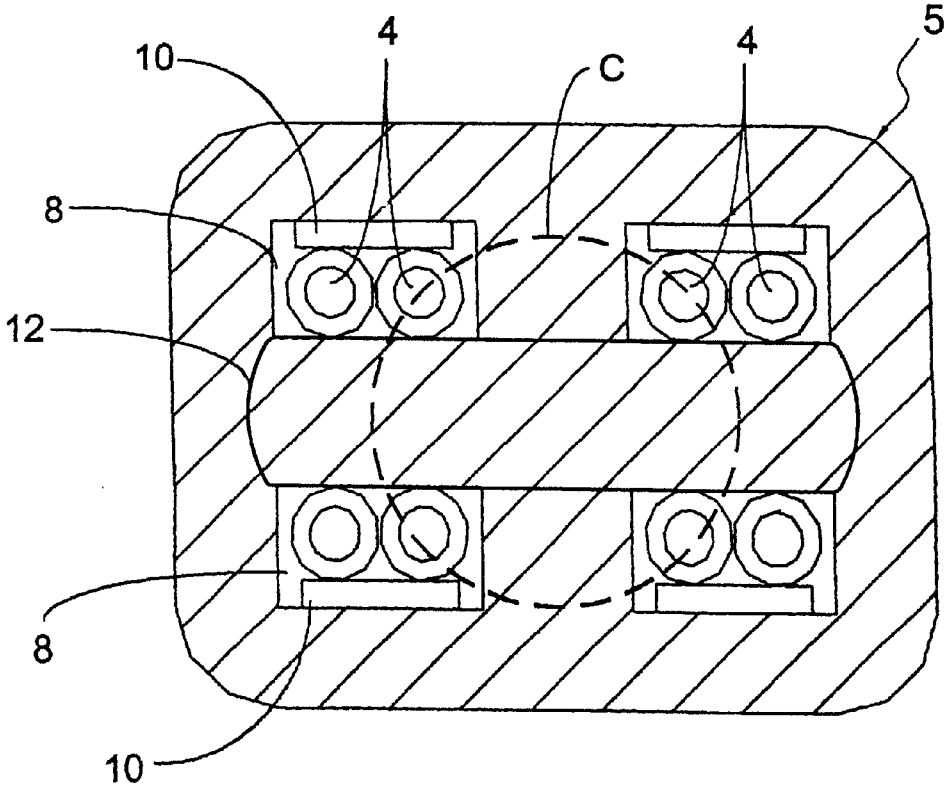

With reference to FIGS. 4 and 5, a lead-in connection according to the invention will have a lead-in connector 5 with a number of narrow passages 8 for the individual wire pairs 4, said passages 8 being generally disposed with a distance between them which is considerably greater than the distances between the wire pairs in the cable 2, which is indicated by a dash line circle C.

The respective wire pairs are secured in the individual passages by means of clamping parts 10 in the form of terminal-screws, spring clips or clamps which can be activated individually or collectively.

As shown in FIG. 4, use can possibly be made of a special filling-out element 12 in to form inner wall parts of the passages 8, said element having a wedge-shaped projecting part 14 which supports the wire pairs where they branch out from the signal cable.

Moreover, a gradual change in impedance will hereby be achieved at the transition between the cable and the lead-in element, which will minimize signal reflections from the area. The cable jacket 2 itself is correspondingly cut back and thus does not in any way form an immediate part of the strain-relieving element. However, this will still be particularly effective in that all of the wire pairs are secured separately, and thus it will further apply that this securing will be effected with the wire pairs so widely separated a that, from the electrical point of view, the positions in which the individual wires in the wire pairs are mutually disposed in the clamped-in condition will not be of any significance.

Figure 6:
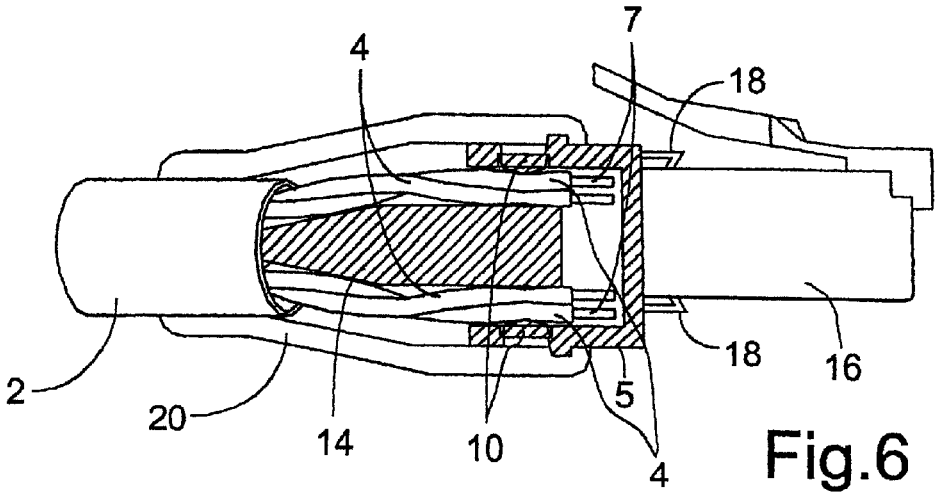
FIG. 6 shows a lead-in element according to the invention which is in the form of an element which is connected mechanically to a connection plug.

In FIG. 6 it is shown that the lead-in element 5 can be in the form of a separate element which can be connected mechanically to a connection plug 16, e.g., by means of retaining hooks 18. Moreover, it is shown that the same element can be connected to a casing 20 which extends rearwards over the outer end of the cut-back cable jacket 2, and thereby stabilizes this end against sharp bending-out immediately outside the lead-in element 5.

Figure 7:
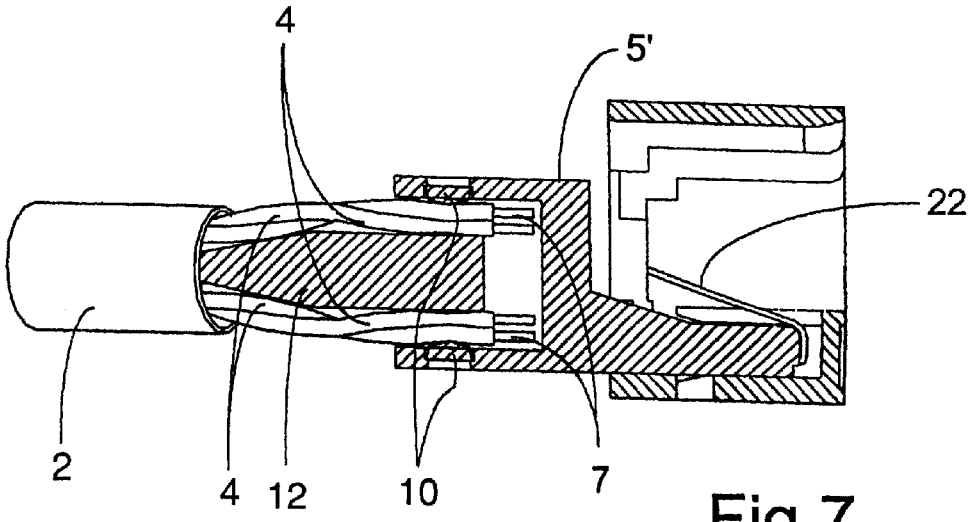
FIG. 7 is a corresponding view of strain-relieving elements as in integral part of a connection element.

In the example shown in FIG. 7, the lead-in element 5' is configured as an intergrated part of a connection element with contact springs 22 for connection with a corresponding plug element.

The invention will not only comprise the relevant lead-in elements with or without plug or apparatus parts, but also -these units in the wire-mounted condition, where the signal wire pairs are arranged as disclosed here. The elements will also be able to be used even though the wires are not all grouped in well-defined "pairs."

What is claimed is:

1. A termination or strain-relieving element for a signal cable having at least two wire pairs, said element comprising:

a lead-in connector having a pair of mutually separated lead-in passages for individual wire pairs of the connected cable, said passages being spaced apart by a distance which is greater than a spacing of the wire pairs in the cable;

a clamping means associated with each of said passages for providing strain relief to a wire pair led therethrough said clamping means comprising a respective clamping element for each passage; and a projecting wedge part for insertion into the cable and for supporting the wire pairs in an even and outwardly inclined manner increasing the spacing of the wire pairs in a direction toward the lead-in connector.

2. Termination or strain-relieving element according to claim 1, further comprising a connection plug and a connector for mechanically connecting the plug to the lead-in connector to the connection plug.

3. Termination or strain-relieving element according to claim 1, further comprising a connection piece for surrounding and frictionally engaging an outer jacket of a cable.

4. Termination or strain-relieving element according to claim 1, wherein said means is one of terminal screws, spring clips and clamps.

5. Termination or strain-relieving element according to claim 1, wherein said projecting wedge part is part of a filling-out element which forms inner wall parts of the passages, and wherein said wedge part supports the wire pairs at a location where the wire pairs branch out from the signal cable.

* * * * *